US007140299B2

(12) United States Patent
Fujiwara

(10) Patent No.: US 7,140,299 B2
(45) Date of Patent: Nov. 28, 2006

(54) PRINTING PRESS HAVING PLATE SUPPLY AND DISCHARGE APPARATUS INCLUDING SHIFTABLE GUIDE PLATE AND GUIDE

(75) Inventor: Shigeo Fujiwara, Fuchu (JP)

(73) Assignee: Ryobi Ltd., Hiroshima-Ken (JP)

( * ) Notice: Subject to any disclaimer, the term of this patent is extended or adjusted under 35 U.S.C. 154(b) by 0 days.

(21) Appl. No.: 11/165,395

(22) Filed: Jun. 23, 2005

(65) Prior Publication Data

US 2005/0284323 A1 Dec. 29, 2005

(30) Foreign Application Priority Data

Jun. 25, 2004 (JP) ..... 2004-188022

(51) Int. Cl.
*B41F 27/12* (2006.01)

(52) U.S. Cl. ..... 101/477; 101/415.1

(58) Field of Classification Search ..... 101/477, 101/415.1, 479, 480, 216, 378
See application file for complete search history.

(56) References Cited

U.S. PATENT DOCUMENTS 5,511,478 A * 4/1996 Lindner et al. ..... 101/477
5,738,015 A * 4/1998 Kusch et al. ..... 101/477

FOREIGN PATENT DOCUMENTS

JP 05-026374 U 4/1993
JP 07-290690 11/1995
JP 2844231 B 10/1999
JP 3066614 B 5/2000

* cited by examiner

*Primary Examiner*—Leslie J. Evanisko
(74) *Attorney, Agent, or Firm*—The Webb Law Firm

(57) ABSTRACT

There is provided a printing press that can guide a printing plate, which is held in clamped relationship with the clamping gripper, so as to be mounted on the plate cylinder with accuracy, while guiding a printing plate in the plate discharge direction with accuracy, as well as preventing deterioration of the reliability for a long time. A printing plate guide plate having a leading end provided with guide rollers and guide blocks guides a printing plate when it is supplied to a plate cylinder and discharged therefrom. A pivotally moving plate auxiliarily guides the printing plate when it is guided by the printing plate guide plate. A link mechanism links the printing plate guide plate with the pivotally moving plate so as to switch guide members for guiding the printing plate by the contact from guide rollers to guide blocks or vice versa, so that when the printing plate guide plate is held at a plate supply position, the guide rollers contact the printing plate at a first guide position, and when the printing plate guide plate is held at a plate discharge position, the guide blocks contact the printing plate at a second guide position.

3 Claims, 11 Drawing Sheets

PRINTING PRESS HAVING PLATE SUPPLY AND DISCHARGE APPARATUS INCLUDING SHIFTABLE GUIDE PLATE AND GUIDE

CROSS REFERENCE TO RELATED APPLICATION

This application claims priority from Japanese Patent Application No. 2004-188022, which is incorporated herein by reference.

BACKGROUND OF THE INVENTION

1. Field of the Invention

The present invention relates to a printing press and more particularly a structure of a printing section disposed between a sheet feeding section and a sheet discharge section so as to supply a printing plate to a clamping gripper that is mounted on a plate cylinder and mount the same on the plate cylinder.

2. Related Art

A sheet-fed printing press (hereinafter referred simply to a printing press) generally includes a printing section between a sheet feeding section and a sheet discharge section. This printing section is to print on sheets by a printing plate mounted on a plate cylinder mounted inside of a body cover. The printing press is generally equipped with a printing plate mounting device that automatically mounts a printing plate, which has been manually inserted into a clamping gripper mounted on the plate cylinder. According to a recently proposed printing press, an automatic supply mechanism is employed to automatically supply a printing plate (a new plate), which has been once set at a predetermined position by an operator, to a clamping gripper.

Also, there is proposed another type of a printing press equipped with a guide device that guides a printing plate, which has been released from a clamping gripper, to a plate discharge device both in plate supply and discharge operations. For example, Japanese Patent Application Laid-open No. Hei-07-290690 proposes a guide device, in which a plate supply roller and a plate discharge roller are eccentrically mounted in pair on a shaft so as to rotate the plate supply roller around the support shaft, thereby forming a plate supply passage in a plate supply operation by a plate supply device, and rotate the plate discharge roller around the support shaft, thereby forming a plate discharge passage in a plate discharge operation by a plate discharge device.

The changing of the rollers to be used respectively for the plate supply and discharge operations is necessary due to the use of ink, solvent and the like in a printing operation. That is, it is necessary to avoid a problem associated with a case where the same roller is used both in the plate supply and discharge operations, that is, a problem that the roller with ink attached thereto during the plate discharge operation must be used for guiding a printing plate to be supplied.

According to the shifting operation in the above printing press to select whether the plate supply roller or the plate discharge roller is to be used for guiding a printing plate, a friction roller separately provided from the plate supply roller and the plate discharge roller is brought into contact with a plate cylinder, and the shifting is made according to the rotational amount of this friction roller, so that the plate supply roller is moved closer to the clamping gripper in the plate supply operation and the plate discharge roller is moved closer to the clamping gripper in the plate discharge device.

For the selection of the roller for use by the contact of the friction roller with the plate cylinder in the above conventional guide device of the printing press, a possibility of slippage of the friction roller on the plate cylinder must be taken into account. Such slippage may deteriorate the reliability of the plate discharge device as the time of use of the plate discharge device elapses.

It is an object of the present invention to provide a printing press that is capable of guiding a printing plate, which is held in clamped relationship with the clamping gripper, so as to allow the same to be mounted on the plate cylinder with accuracy, while guiding a printing plate in the plate discharge direction with accuracy, as well as maintains the reliability for a long time.

SUMMARY OF THE INVENTION

According to one aspect of the present invention, there is provided a printing press that includes: a plate cylinder for mounting a printing plate thereon; a clamping gripper disposed on the plate cylinder for gripping the printing plate; and a printing plate guide plate for supplying a printing plate to the plate cylinder in a plate supply operation so as to have a leading edge of the printing plate clamped by the clamping gripper, and discharging the printing plate from the plate cylinder in a plate discharge operation. The printing plate guide plate is shiftable between a plate supply position enabling supply of the printing plate to the clamping gripper and a plate discharge position enabling discharge of the printing plate in a plate discharge direction. The printing press further includes a guide for guiding the printing plate during the printing plate with the leading edge clamped by the clamping gripper is mounted on the plate cylinder in the plate supply operation, and guiding the printing plate in the plate discharge direction in the plate discharge operation. The guide has a leading end provided with a guide portion, and is shiftable between a first guide position at which the guide has the guide portion located in a plate supply passage between the printing plate guide plate and the clamping gripper and is held at a first inclined angle relative to a reference plane allowing the guide portion to contact the printing plate in the plate supply passage, and a second guide position at which the guide has the contact portion located in a plate discharge passage formed radially outward of the plate cylinder relative to the clamping gripper and is held at a second inclined angle different from the first inclined angle relative to the reference plane allowing the guide portion to contact the printing plate in the plate discharge passage. The printing press further includes a shifting means, through which the printing plate guide plate is linked with the guide, so that the guide is shifted to the first guide position simultaneously when the printing plate guide plate is shifted to a plate supply position and the guide is shifted to the second guide position simultaneously when the printing plate guide plate is shifted to a plate discharge position.

With the above printing press, the guide is shifted to the first guide position, at which the guide portion is located in the plate supply passage, by the shifting means simultaneously when the printing plate guide plate is shifted to the plate supply position. Whereby, the printing plate with the leading edge clamped by the clamping gripper is guided so as to be mounted on the plate cylinder by the guide. On the other hand, the guide is shifted to the second guide position, at which the guide portion is located in the plate discharge passage, by the shifting means simultaneously when the printing plate guide plate is shifted to the plate discharge position. Whereby, it is possible to discharge the printing plate from the clamping gripper while guiding the printing plate with its printing surface held in contact with the guide portion of the guide.

Meanwhile, for the printing press of the above type, ink or solvent is attached to a used printing plate after printing. The guide, which has the guide portion adapted to guide the printing plate by the contact therewith, is held at different inclined angles relative to the reference plane respectively for the first guide position and the second guide position. Accordingly, even if the same guide portion is used for both the first guide position and the second guide position, the guide portion can contact the printing plate through different contacting areas when the guide is held respectively at the first guide position and the second guide position. This makes it possible to effectively prevent ink, solvent or the like of a used printing plate, which has been attached to the guide portion, from being attached to a new printing plate, as well as protecting a new printing plate from ink which has been attached to the guide portion and dried thereon. As an additional advantage of the printing press having the above arrangement, the shifting means, which links the guide with the printing plate guide plate for the associated or simultaneous operation, can omit the necessity to separately provide a control device that changes the position of the guide by electric control, an electric motor that is driven by this control device, or other complicated mechanism.

The guide portion is preferably made up of at least one first guide member that is capable of contacting the printing plate only when the guide is held at the first guide position, and at least one second guide member that is capable of contacting the printing plate only when the guide is held at the second guide position. With this arrangement, the different guide members can contact a printing plate respectively at the first guide position and the second guide position. This makes it possible to more effectively prevent ink, solvent or the like of a used printing plate, which has been attached to one of the guide members, from being attached to a new printing plate.

The printing press preferably further includes a body cover having an opening for insertion of a printing plate. In this arrangement, the printing plate guide plate is pivotally movably mounted to the body cover via a support shaft, so that when the printing plate guide plate is held at the plate supply position at which the printing plate guide plate is inclined towards the plate cylinder so as to open the opening of the body cover, the guide is shifted to the first guide position at which the guide is held at an angle inclined towards a space between the opening of the body cover and the plate cylinder so as to cover the plate cylinder from the outside of the body cover. With this arrangement, when the opening of the body cover is opened by shifting the printing plate guide plate to the plate supply position, the guide is simultaneously shifted to the first guide position at which the guide is held at an angle inclined towards a space between the opening of the body cover and the plate cylinder. This allows the guide to cover the plate cylinder, the clamping gripper and other driving members, and hence improves a safety environment for the operator.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Figure 1:
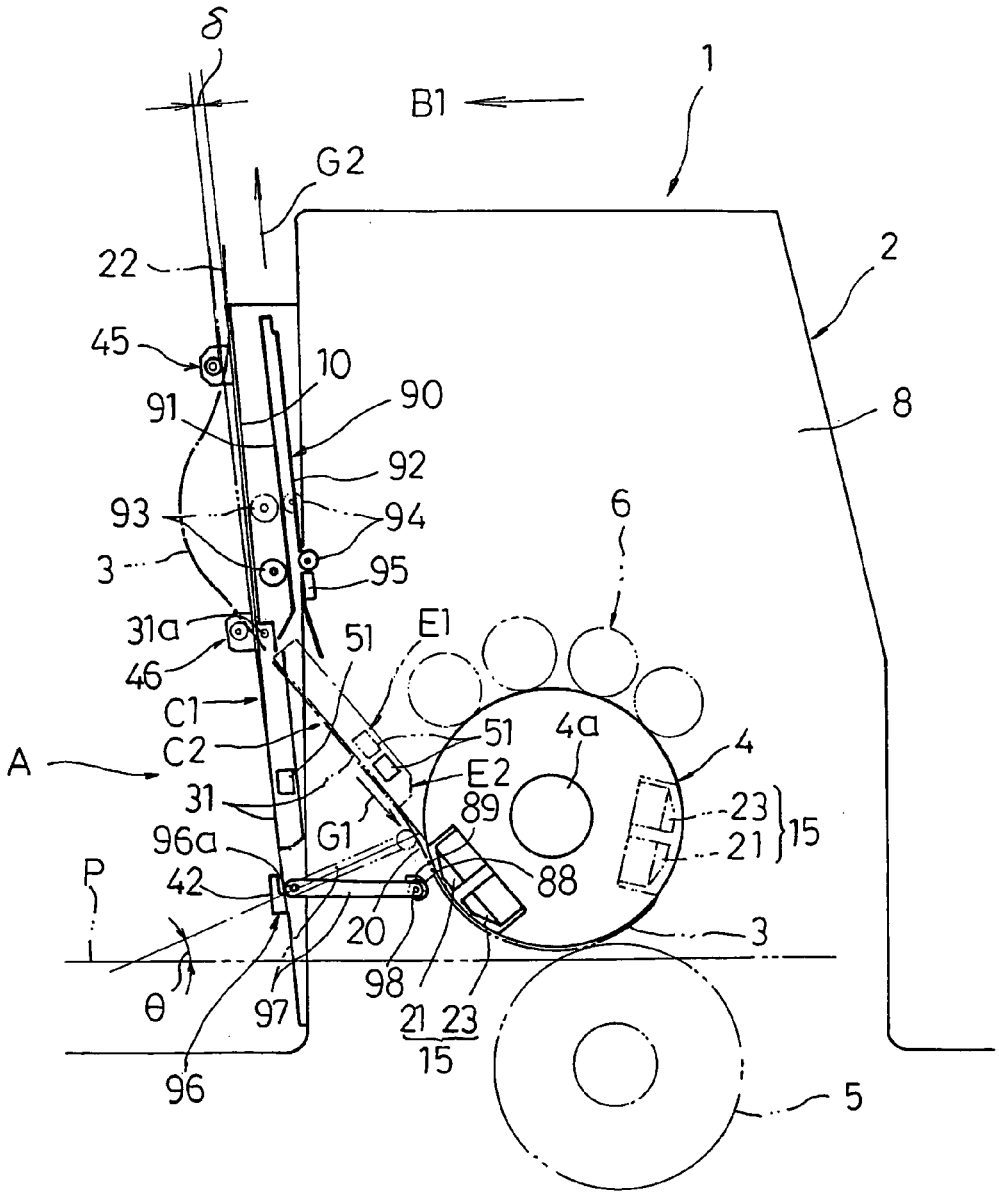
FIG. 1 is a schematic cross sectional view illustrating the motion of a printing press in a plate supply operation, according to an embodiment of the present invention.
Figure 2:
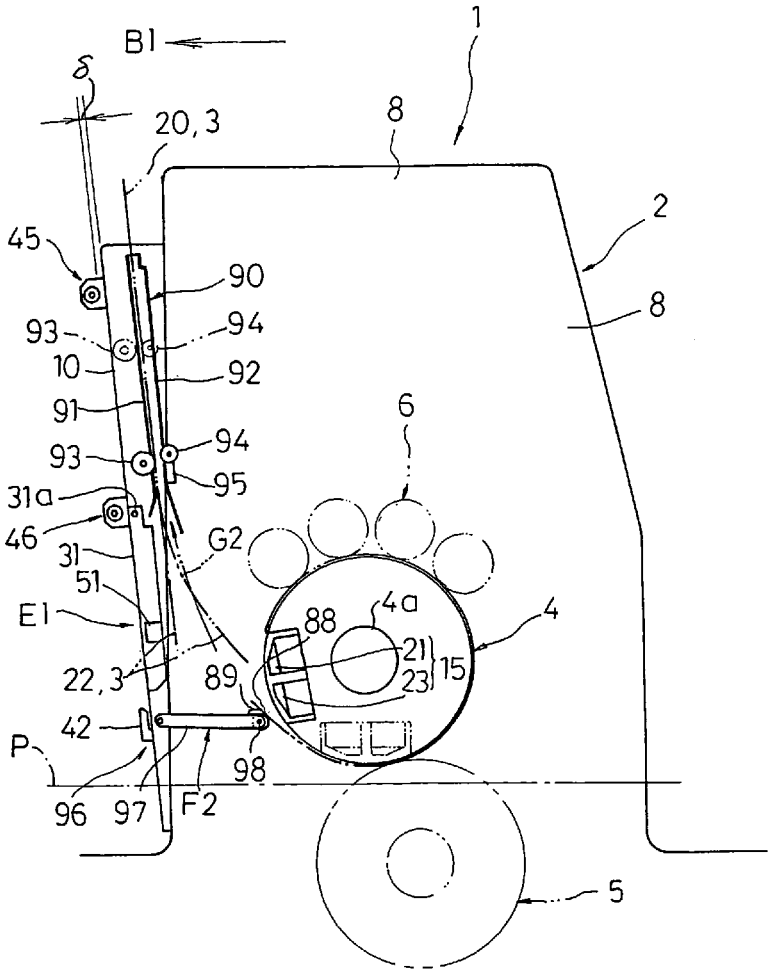
FIG. 2 is a schematic cross sectional view illustrating the motion of the printing press in a plate discharge operation.
Figure 3:
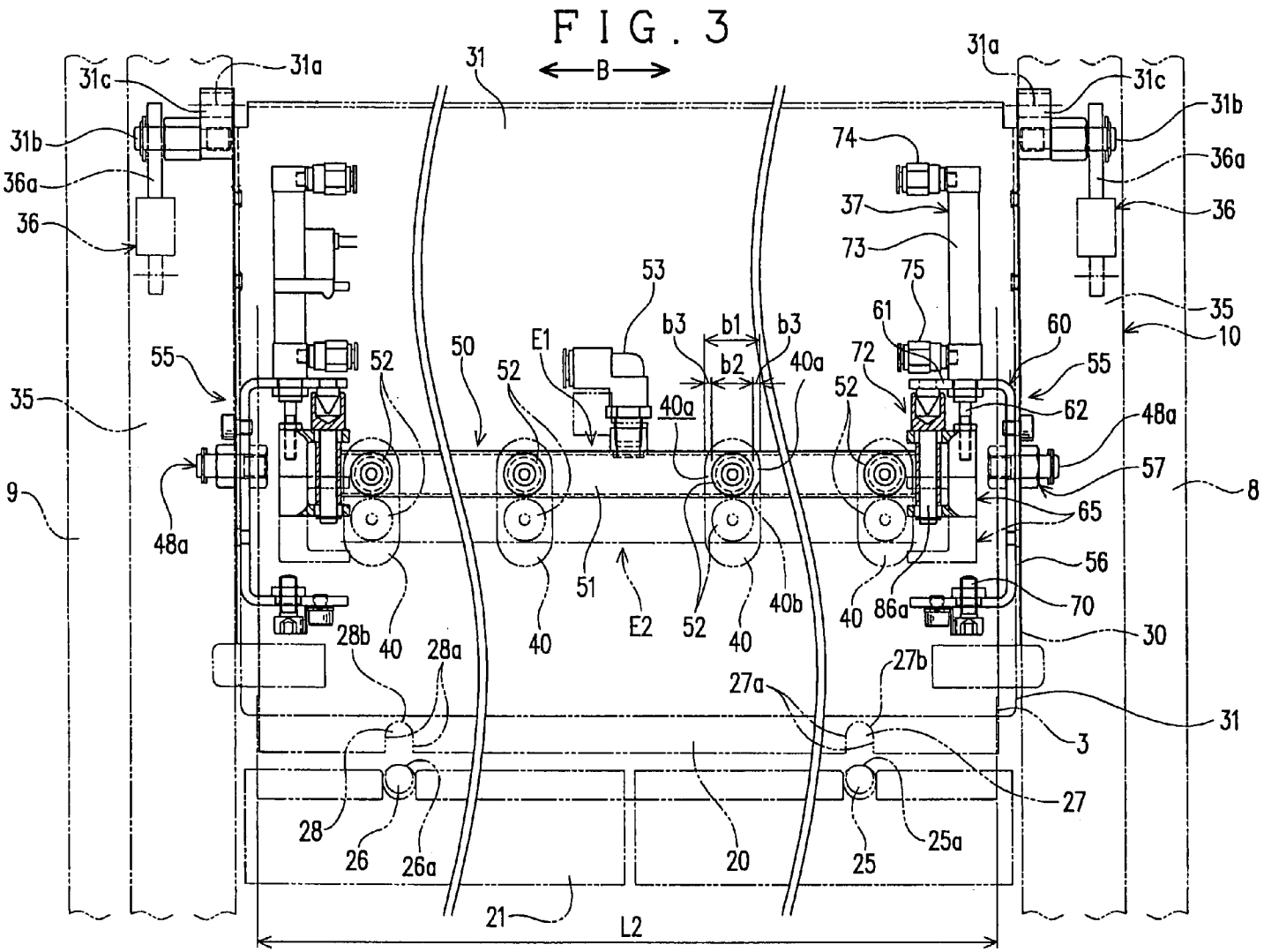
FIG. 3 is a rear view of a printing plate guide plate with a plate supply device of the printing press.
Figure 4:
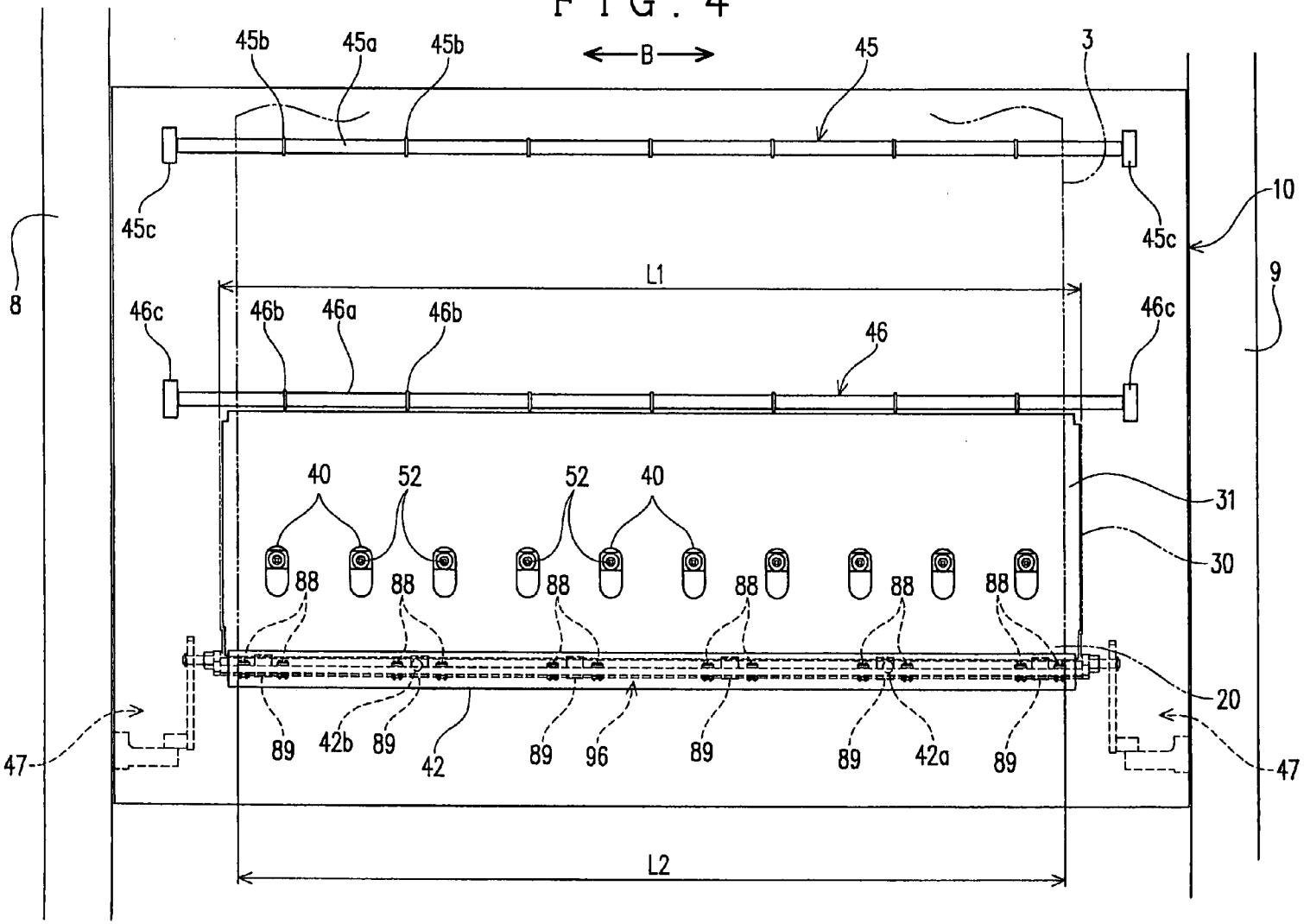
FIG. 4 is a front view of a downstream sided front panel of the printing press.
Figure 5:
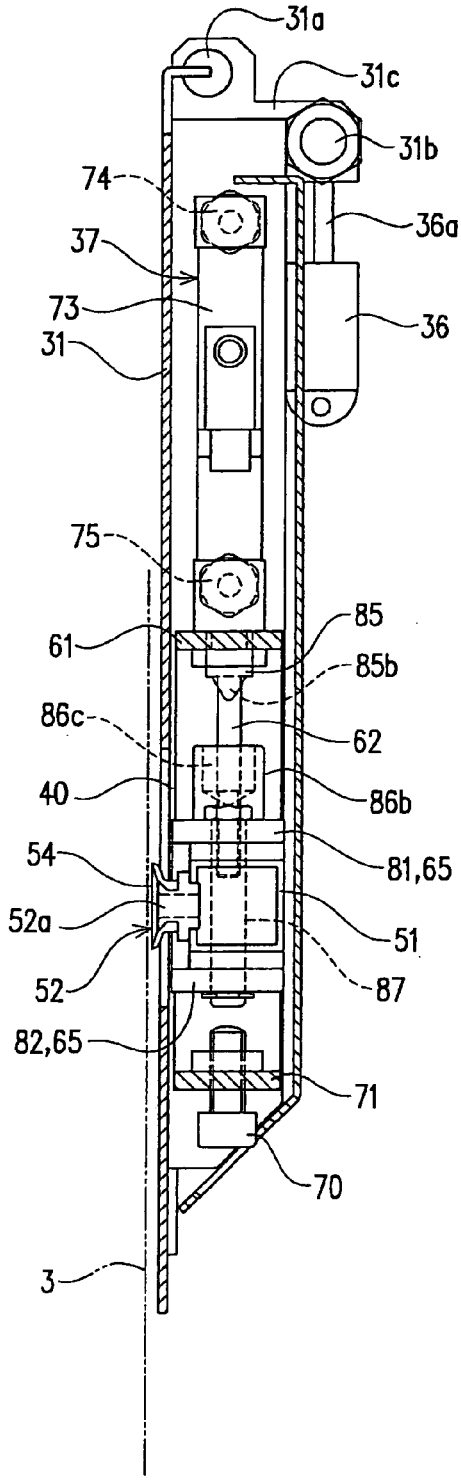
FIG. 5 is a lateral cross sectional view of the downstream sided front plate with the plate supply device.
Figure 6:
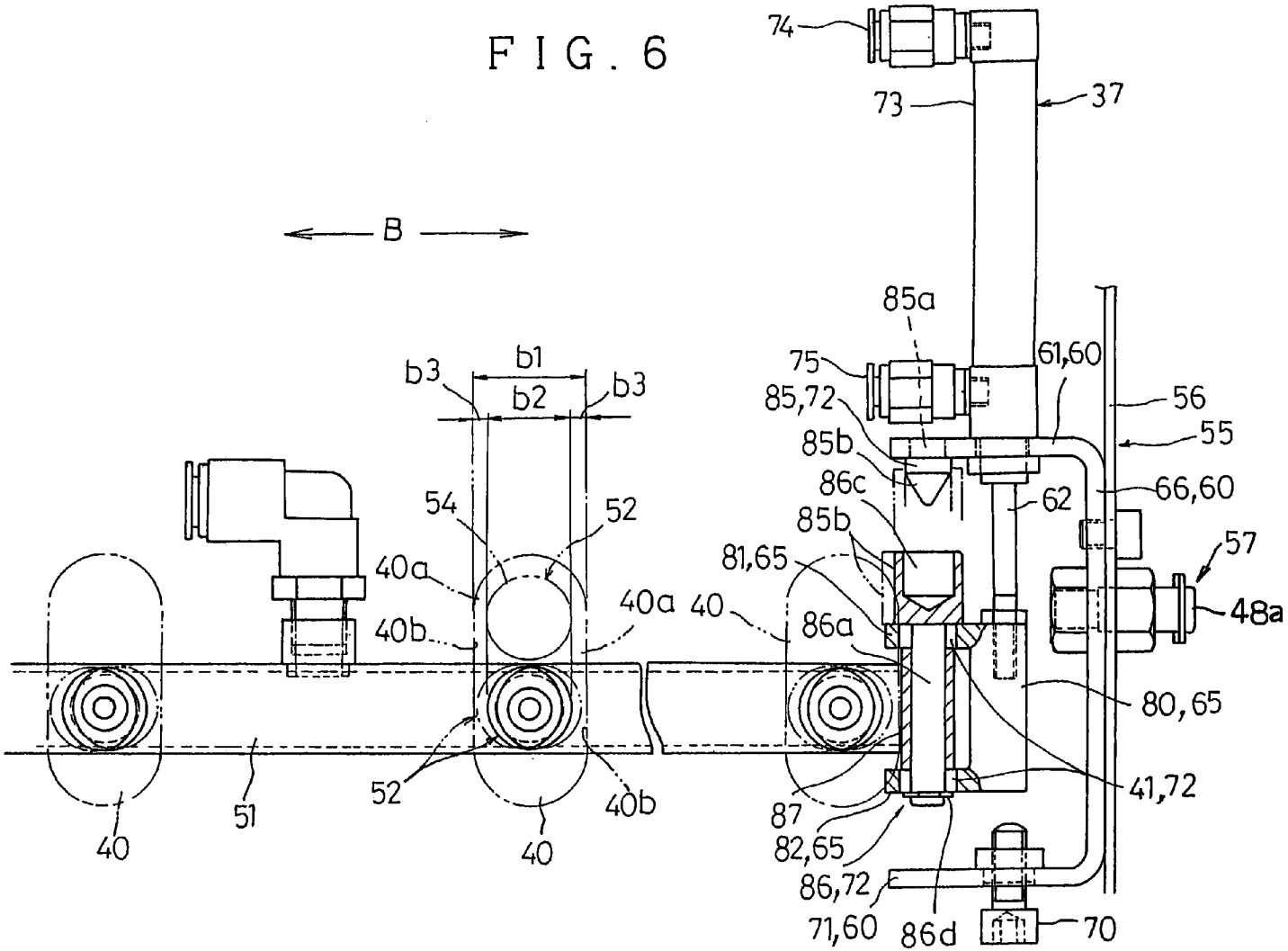
FIG. 6 is an enlarged view of the plate supply device with a partly broken-out section.
Figure 7:
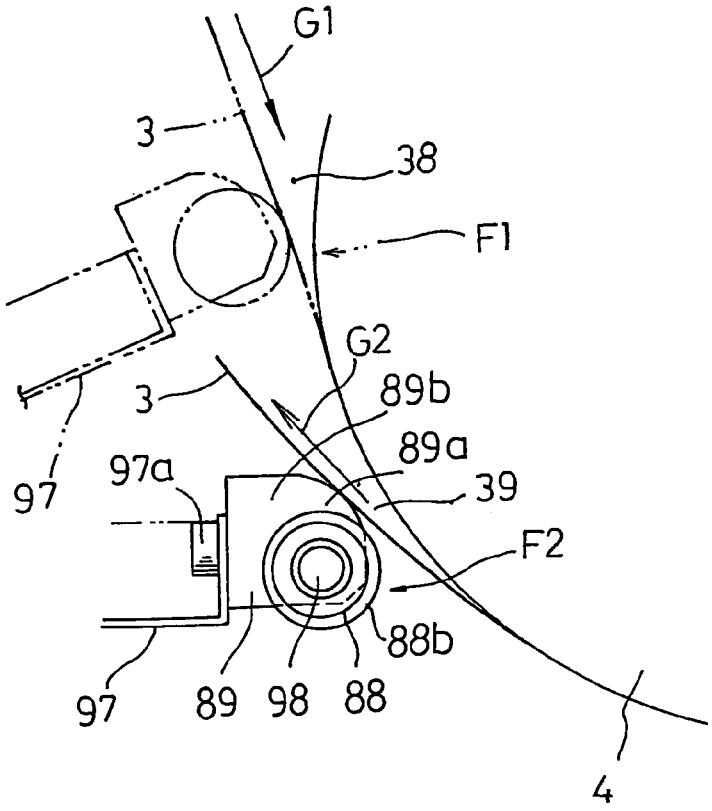
FIG. 7 is an enlarged side view illustrating the structure and operational positions of a guide portion mounted on a leading end of a pivotally moving plate.
Figure 8:
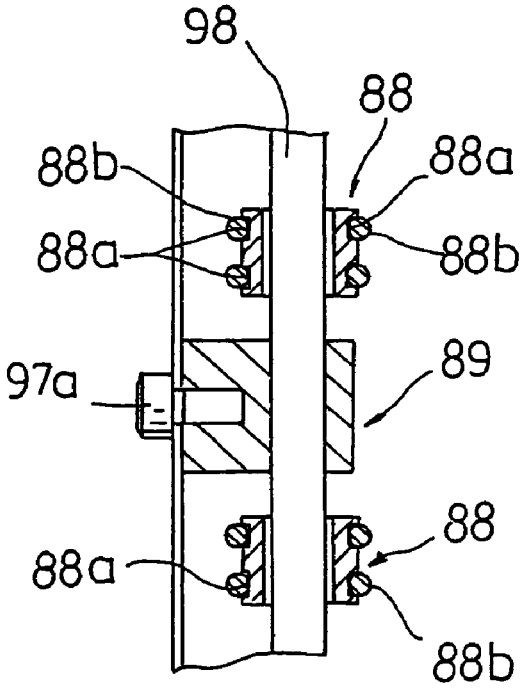
FIG. 8 is a cross sectional view illustrating the structure of the guide portion.

Now, the description will be made for an embodiment of a printing press by taking for example a sheet-fed printing press with reference to the drawings attached hereto. FIGS. 1 and 2 are schematic lateral cross sectional views of a printing section of a sheet-fed printing press. FIG. 3 is a rear view of a printing plate guide plate illustrating the structure of a plate supply device. FIG. 4 is a front view of a downstream sided front plate. FIG. 5 is a lateral cross sectional view illustrating the structure of the plate supply device. FIG. 6 is an enlarged view of a partly broken-out section of FIG. 3. FIGS. 7–11 are explanatory views for the structure of a shifting means and operational views of the plate discharge device.

Generally, a sheet-fed printing press has a sheet feeding section on the upstream side, a sheet discharge section on the downstream side and a printing section (also called as a printing unit) therebetween. All the Figures attached hereto illustrate the structure of a printing section 1. In this embodiment, only the single printing section 1 is illustrated for ease of explanation, although plural numbers of printing sections are to be set out between the sheet feeding section and the sheet discharge section according to the number of ink colors to be used for printing.

As illustrated in FIGS. 1 and 2, the printing section 1 includes a body cover 2, a plate cylinder 4 disposed inside of the body cover 2 for mounting of a printing plate 3 thereon, an inking device with plural ink rollers 6 for supplying ink to the plate cylinder 4, and a plate supply device A for supplying a printing plate to the plate cylinder 4. The plate cylinder 4 is rotatably supported by opposite lateral plates 8, 9 via a support shaft 4*a*. A reference numeral 5 represents a rubber cylinder (a blanket cylinder) to be held in contact with the plate cylinder in a rotatable manner. The body cover 2 includes the opposite lateral plates 8, 9, and a downstream sided front panel 10 disposed on a downstream side B1 between the opposite lateral plates 8, 9. The downstream sided front panel 10 is mounted between the opposite lateral plates 8, 9 in such a manner as to be movable in the vertical direction, thereby enabling closing and opening of the downstream side B1 between the opposite lateral plates 8, 9.

The plate cylinder 4 includes a known clamping gripper 15 for gripping the printing plate 3, which includes a leading-edge clamping member 21 for gripping a leading edge 20 (as a gripper receiving edge) of the printing plate 3 and a trailing-edge clamping member 23 for gripping a trailing edge 22 of the printing plate 3, both members being disposed in pair in the circumferential direction. Specifically, the trailing-edge clamping member 23 is disposed so as to be adjacent to the leading-edge clamping member 21 in the circumferential direction, in which the plate cylinder 4 is rotated for mounting printing plate 3 thereon, so that the trailing-edge clamping member 23 is located below the leading-edge clamping member 21 when the leading edge 20 of the printing plate 3 is inserted into the leading-edge clamping member 21 of the plate cylinder 4.

As illustrated in FIG. 3, the leading-edge clamping member 21 has a pair of protrusions 25, 26 as positioning members, each having a cylindrical column shape disposed with a given distance from each other in an axial direction B of the plate cylinder 4 (hereinafter referred to a width direction B). The leading edge 20 of the printing plate 3 forms cutouts 27, 28 as engaged members for engagement with the protrusions 25, 26. At least one of the cutouts 27, 28 has a bottom wall 27*b* or 28*b* of a semi-circular shape having a curvature substantially corresponding to a curvature of an outer circumference 25*a* or 26*a* of the protrusion 25 or 26, and lateral side walls 27*a*, 28*a* extending straightforward from the opposite ends of each of the bottom walls 27*b*, 28*b*.

As illustrated in FIGS. 3 and 4, the downstream sided front panel 10 has a lower portion forming an opening 30 of a rectangular shape for insertion of the printing plate 3. The plate supply device A has a printing plate guide plate 31 for opening and closing the opening 30. The printing plate guide plate 31 has a width L1 greater than a width L2 of the printing plate 3. The printing plate guide plate 31 is pivotally movably mounted via a support shaft 31*a* extending between the opposite lateral portions of the rear side of the downstream sided front panel 10. The downstream sided front panel 10 has lateral portions 35 to which cylinder devices 36 are pivotally movably mounted so as to shift the printing plate guide plate 31 between a printing plate setting position C1 at which the opening 30 is closed with the guide plate 31 and a printing plate supply position C2 at which the guide plate 31 is pivotally moved towards the clamping gripper 15. A leading end of a rod 36*a* of each cylinder device 36 is mounted to an operation shaft member 31*b* parallel to the width direction B so as to control the position of the printing plate guide plate 31. This operational shaft member 31*b* is connected via a connection member 31*c* to a support shaft 31*a* that extends parallel to the width direction, around which support shaft 31*a* the printing plate guide plate 31 is pivotally moved. The support shaft 31*a* is pivotally movably mounted to a corresponding one of the lateral portions 35 of the downstream sided front panel 10. The printing plate guide plate 31 is pivotally moved integrally with the support shaft 31*a* via the connection members 31*c* by moving forward and backward the rods 36*a* upon driving of the cylinder devices 36 so as to be shifted between the printing plate setting position C1 and the printing plate supply position C2. A plate surface of the printing plate guide plate 31 has plural elongated holes 40 extending along the plate surface in a direction orthogonal to the width direction B (hereinafter referred to a vertical direction) and aligned to each other in the width direction B.

The plate supply device A has on the front side of the downstream sided front panel 10 a receiving frame member 42 having a length substantially equal to the width of the printing plate guide plate 31 and located downstream of a lower edge of the opening 30 in an overlapping manner therewith. The receiving frame member 42 has on the side facing the printing plate guide plate 31 a pair of positioning members (protrusions 42*a*, 42*b*) that are engageable with portions (cutouts 27, 28) of the printing plate 3, through which the printing plate 3 is supported in position. Provided between the lower portion of the printing plate guide plate 31 and the receiving frame member 42 is a clearance for allowing the insertion of the leading edge 20 of the printing plate 3 when the opening 30 is closed with the printing plate guide plate 31. A pair of printing plate guide rods 45, 46, which are located in parallel above and below each other, are rotatably mounted via brackets 45*c*, 46*c* on the front upper portion of the downstream sided front panel 10, both rods being greater in length than the printing plate 3 in the width direction B. These printing plate guide rods 45, 46 are disposed with a given distance in the vertical direction, each having a clearance of a distance δ allowing for passing of the printing plate 3 therethrough from the front side of the downstream sided front panel 10. The printing plate guide rods 45, 46 each have large diameter portions 45*b*, 46*b*, which are slightly greater in diameter than ordinary diameter portions 45*a*, 46*a* between the opposite ends of the printing plate guide rods 45, 46.

The plate supply device A has a sucker 50 for sucking a rear side of the printing plate 3 and holding the printing plate 3. The sucker 50 is disposed on the rear side of the printing plate guide plate 31. The sucker 50 includes a suction pipe 51 having a length smaller than the printing plate guide plate 31 in the width direction and plural suction nozzles 52 protruding forward from the suction pipe 51 so as to be respectively inserted into the elongated holes 40. This sucker 50 is shiftable between a suction position E1 allowing the suction nozzles 52 to be held at the upper portions of the corresponding elongated holes 40 and suck the printing plate 3, and a plate supply position E2 allowing the suction nozzles 52 with the printing plate 3 sucked therewith to be held at the lower portions of the corresponding elongated holes 40, that is, held close to the clamping gripper 15. The suction pipe 51 with opposite ends closed is connected to a suction pump (not shown) via a suction joint 53 connected to a middle portion of the suction pipe 51.

As illustrated in FIG. 5, the suction nozzles 52 are mounted to the suction pipe 51 so as to respectively have nozzle ports 54 slightly protruding forward from the printing plate guide plate 31, and each have at its center a suction hole 52*a* for communication with the suction pipe 51. As illustrated in FIG. 6, a width b1 of each elongated hole 40 is larger than a maximum diameter b2 of the nozzle port 54 of the corresponding suction nozzle 52, so that clearances 40*a* each having a width b3 are provided between opposite circumferential walls 40*b* of the elongated hole 40 and the nozzle port 54. A pair of support devices 55 are provided to support the suction pipe 51, allowing the suction pipe 51 to be reciprocated in the vertical direction, and allowing the same to be reciprocated along the plate surface of the printing plate guide plate 31 in the width direction B. The pair of support devices 55 are mounted at the opposite ends of the sucker 50 in the width direction B on the rear side of the printing plate guide plate 31. The both support devices 55 have an identical structure, and therefore the description will be made only for one of the support devices 55. The support device 55 includes a bracket 60 fixed to a bent plate portion 56, which is formed by bending a lateral portion of the printing plate guide plate 31*a*, with a fixing means 57 in the form of a bolt and a nut, a cylinder device (air cylinder device) 37 fixed to an upper plate portion 61 of this bracket 60, a support block 65 fixed to a leading end of a rod 62 of the cylinder device 37, and a block positioning mechanism 72 provided to the support block 65 and the upper plate portion 61 of the bracket 60.

The bracket 60 has a mounting portion 66 for allowing itself to be fixed to the bent plate portion 56 via the fixing means 57, the upper plate portion 61 formed by bending an upper part of the mounting portion 66, and a lower plate portion 71 formed on the lower part of the mounting portion 66 and having a stopper 70 (hereinafter described), thus forming a reversed C-shape with its left-hand side opened when viewed from the front side. The cylinder device 37 is designed to allow the rod 62 to be vertically reciprocated by having a cylinder portion 73 fixed to the upper plate portion 61 in the vertical direction. Air supply joints 74 and 75 are provided on the lateral sides of the opposite longitudinal ends of the cylinder portion 73.

The support block 65 has a dimension smaller than the height in the lengthwise direction of the mounting portion 66 of the bracket 60 and disposed between the upper plate portion 61 and the lower plate portion 71. This support block 65 has a body 80 fixed to the leading end of the rod 62, and support pieces 81, 82 respectively disposed on the opposite sides of the body 80 in the lengthwise direction (vertical direction), substantially parallel to the upper and lower plate portions 61, 71, thus forming a reversed C-shape with its left-hand side opened when viewed from the front side. The stopper 70 is disposed opposite to the body 80 of the support block 65 in the lengthwise direction so as to have an upper end protruding upward from the lower plate portion 71 towards the body 80 of the support block 65. The block positioning mechanism 72 has a protrusion 85 mounted on the upper plate portion 61 of the bracket 60, a moving member 86 extending through the support pieces 81, 82 of the support block 65, and an elongated hole 41 formed in the support pieces 81, 82 for allowing a shaft portion 86*a* of the moving member 86 to be inserted therein in such a manner as to be movable in the width direction B.

The protrusion 85 has a proximal end 85*a* inserted into the upper plate portion 61 of the bracket 60 and mounted thereto, while the protrusion 85 has a distal end 85*b* having a cone shape with a gradually decreasing diameter. A head 86*b* of the moving member 86 has a diameter larger than the elongated hole 41 and has at its center a recess 86*c* for allowing the distal end 85*b* of the protrusion 85 to be brought into and out of engagement therewith. The moving member 86 has an end provided with a retaining member 86*d* for preventing the shaft portion 86*a* of the moving member 86 from falling from the elongated hole 41. A corresponding one of the opposite ends of the suction pipe 51 is located between the support pieces 81, 82 of the support block 65 and is integrally formed with a closing member 87 fitted around the shaft portion 86*a* of the moving member 86 for closing the corresponding one of the opposite ends of the suction pipe 51.

The plate supply device A has an auxiliary guide device 96 for freely movably guiding the printing plate 3 in the plate supply and discharge operations. The auxiliary guide device 96 includes a pivotally moving plate 97 as a guide supported by the downstream sided front panel 10 via a support shaft 96*a*. The pivotally moving plate 97 has a rod member 98 disposed at its leading end, guide members mounted on the rod member 98 at intervals in the axial direction. The guide members are to guide the printing plate 3, which has been moved in a plate supply direction G1 and has the leading edge 20 clamped by the leading-edge clamping member 21 of the clamping gripper 15, so as to allow the same to be mounted on the plate cylinder 4. These guide members also function to guide the printing plate 3 in a plate discharge direction G2 in the plate discharge operation.

The length of the pivotally moving plate 97 in the width direction B is set substantially equal to the printing plate guide plate 31. The detailed description will be made for the guide members with reference to FIGS. 7 and 8. The guide members comprise guide rollers 88 as first guide members that are capable of contacting the surface of the printing plate 3 only in the plate supply operation, and guide blocks 89 as second guide members that are disposed between the adjacent ones of the guide rollers 88 so as to be capable of contacting the surface of the printing plate 3 only in the plate discharge operation. The guide rollers 88 are formed independently of the guide block 89. The guide rollers 88 are loosely mounted on the rod member 98 so as to be rotatable therearound, and each have a rubber ring 88*b* fitted in a groove 88*a* formed on the outer circumference. The rubber ring 88*b* of each guide roller 88 has a rounded cross section and protrudes away from the outer circumference of the guide roller 88. The guide blocks 89 are mounted through the rod member 98 and secured to the pivotally moving plate 97 via screws 97*a*. The outer circumference of at least an upper portion 89*a* of the leading end of each guide block 89 is formed with a curved surface, and the guide blocks 89 protrude to have the upper portions 89*b* located above the outer circumferences of the guide rollers 88.

As illustrated in FIGS. 1 and 2, the printing section 1 has a plate discharge device 90 for discharging the printing plate 3 mounted on the plate cylinder 4 through an upper portion of the downstream sided front panel 10. The plate discharge device 90 is disposed on the rear upper side of the downstream sided front panel 10 and has a pair of discharge plate guide plates 91, 92 disposed adjacent to each other, and clamping rollers 93, 94 for clamping the printing plate 3 from the front and rear sides (opposite sides). The clamping rollers 93, 94 are disposed so as to be vertically movable by a common air cylinder (not shown) along the discharge plate guide plates 91, 92, in which the clamping roller 94 is disposed so as to be vertically movable along the discharge plate guide plates 91, 92 and be movable towards and away from the clamping roller 93 along with this vertical motion. That is, the clamping roller 94 is spring urged by a spring (not shown) towards the clamping roller 93. A stay 95 is provided on the downstream sided front panel 10 to keep the clamping roller 94 away from the clamping roller 93 when the clamping roller 94 is located at a lower side.

Figure 9:
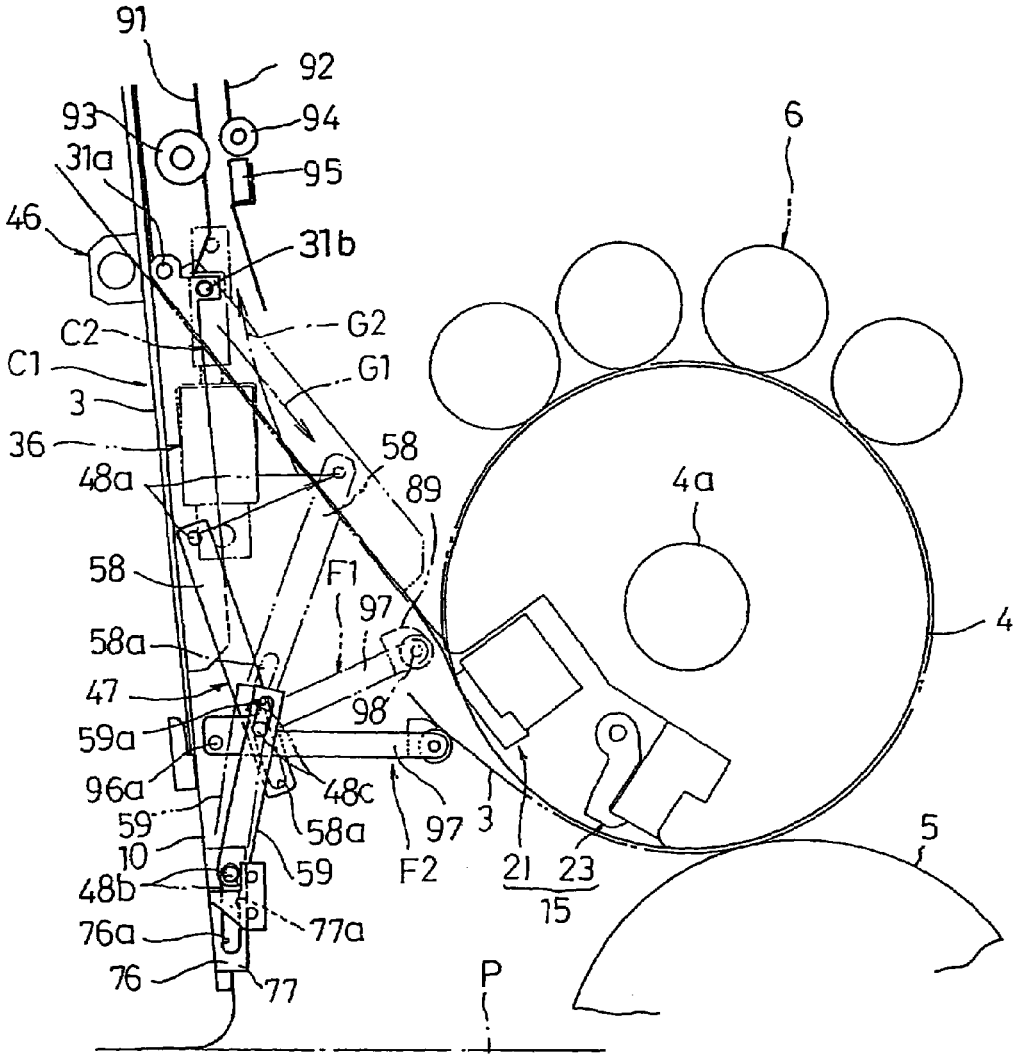
FIG. 9 is a side view illustration a motion of a shifting means according to an embodiment of the present invention.
Figure 10:
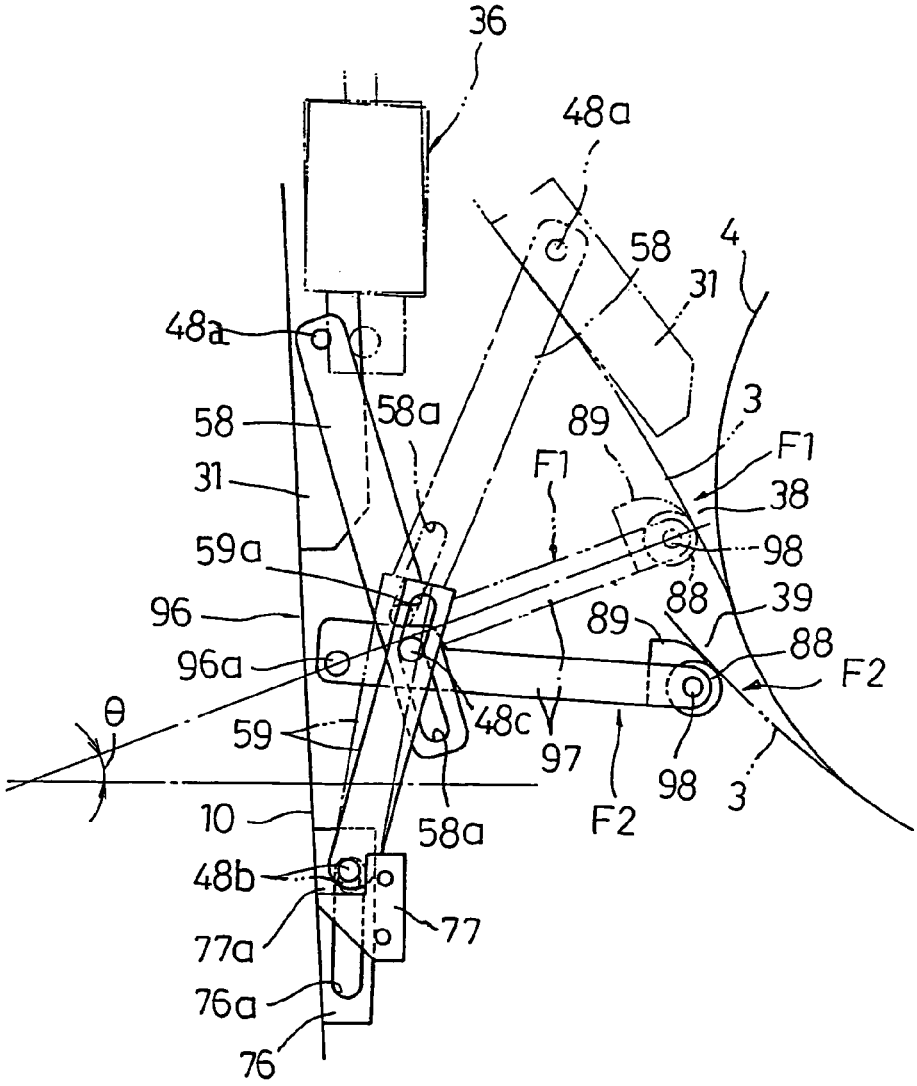
FIG. 10 is an enlarged side view illustrating a motion of the shifting means.
Figure 11:
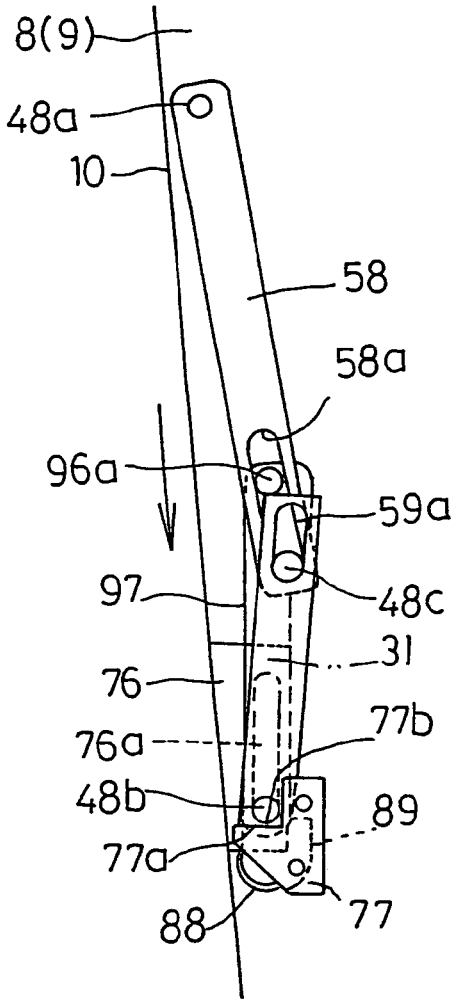
FIG. 11 is a side view illustrating the shifting means before it is attached to a body cover.

At the printing-plate supply position C2 of the printing plate guide plate 31, a plate supply passage 38 for mounting of the printing plate 3 on the plate cylinder 4 is formed between the printing plate guide plate 31 and the clamping gripper 15, more specifically the leading-edge clamping member 21. At the printing-plate setting position C1 of the printing plate guide plate 31, a plate discharge passage 39 is formed radially outward of the clamping gripper 15 and more particularly the trailing-edge clamping member 23. The pivotally moving plate 97 is designed to have different inclined angles relative to the horizontal plane respectively in the plate supply operation and the plate discharge operation. Specifically, the pivotally moving plate 97 in the plate discharge operation is held substantially parallel to the horizontal plane P or held at a slightly downwardly inclined angle around the support shafts 96*a* so as to be pivotally moved upward by an inclined angle of θ relative to the horizontal plane P in the plate supply operation. As illustrated in FIGS. 9–11, in the plate supply operation, a shifting means is provided to shift the pivotally moving plate 97 between a first guide position F1 and a second guide position F2 by changing the inclined angle of the pivotally moving plate 97, in which the guide rollers 88 are located in the plate supply passage 38 so as to contact the printing plate 3 in the plate supply operation when at the first guide position F1, and the guide blocks 89 are located in the plate discharge passage 39 so as to contact the printing plate 3 in the plate discharge operation when at the second guide position F2. As this shifting means 47, a link mechanism for connection between the printing plate guide plate 31 and the pivotally moving plate 97 is used.

The link mechanism 47 as the shifting means has sections provided on the both sides of the width direction B. These sections of the link mechanism 47 are symmetrical in structure and therefore the description will be made only for one of the sections of the link mechanism 47 with reference to FIGS. 7–11. In these Figures, the link mechanism 47 has a first link member 58 that has a proximal end connected to a corresponding lateral side of the printing plate guide plate 31 via a pin 48*a*, and a second link member 59 that has a proximal end connected via a pin 48*b* to a corresponding support bracket 76 mounted to the downstream sided front panel 10. The first link member 58 and the second link member 59 have distal ends respectively having a first elongated hole 58*a* and a second elongated hole 59*a* extending along their longitudinal axes. A control pin 48*c* is mounted to a corresponding lateral side of the pivotally moving plate 97 so as to control the motions of the first link member 58 and the second link member 59. The control pin 48*c* engages with the first link member 58 and the second link member 59 in pivotally and slidingly movable manner. The pin 48*b* loosely engages with an elongated hole 76*a* of the support bracket 76, and the pin 48*b* engages at its end from above with a recess 77*a* of a receiving member 77 fixed to side plates 8, 9.

In the printing section 1 having the above arrangement, as illustrated in FIG. 11, when the downstream sided front panel 10 is not mounted to the body cover 2 or is moved upward away therefrom, the pivotally moving plate 97 of the auxiliary guide device 96 is pivotally moved around the support shaft 96*a* and held in position as hanging downwardly. When the downstream sided front panel 10 is mounted to the body cover 2, the pivotally moving plate 97 is pivotally moved around the support shaft 96*a* in an anticlockwise direction of FIG. 11. That is, when the downstream sided front panel 10 is mounted to the body cover 2 from above with the opening 30 covered by the printing plate guide plate 31, an end of the pin 48*b* contacts a bottom surface 77*b* of the recess 77*a* of the receiving member 77, and when the downstream sided front panel 10 is further moved downward, the pin 48*b* is pressed against the bottom surface 77*b* of the recess 77*a* so as to have the second link member 59 lifted up relative to the support bracket 76. Accordingly, by previously arranging the first link member 58 and the second link member 59 so as to allow their leading or distal ends to move together towards the plate cylinder 4, the control pin 48*c* is brought into engagement with the circumference of the second elongated hole 59*a* and pressed by the pressing force effected by the pin 48*b* pressed against the bottom surface 77*b* of the recess 77*a*, so that the pivotally moving plate 97 is pivotally moved around the support shaft 96*a* with its leading end moving closer to the plate cylinder 4, and then held in upright position substantially parallel to the horizontal plane P, as illustrated in FIG. 9.

Now, the description will be made with reference to FIGS. 9 and 10 for the operation to mount the printing plate 3 on the plate cylinder 4 in a state where the downstream sided front panel 10 has been thus mounted to the body cover 2. For this operation, the operator inserts the printing plate 3 into a clearance between the front side of the downstream sided front panel 10 and the printing plate guide rod 45 while holding the printing plate guide plate 31 at the printing plate setting position C1 at which the opening 30 is closed. Then, the printing plate 3 is moved downward so as to be inserted into a clearance between the front side of the downstream sided front panel 10 and the printing plate guide rod 46 and hence has the leading edge 20 inserted between the printing plate guide plate 31 and the receiving frame member 42. The printing plate 3 is held in position by bringing the engaged portions (the cutouts 27, 28) formed in the leading edge 20 of the printing plate 3 into engagement with the positioning members (the protrusions 42*a*, 42*b*) of the receiving frame member 42. When the printing plate guide plate 31 is held at the printing-plate setting position C1, the pivotally moving plate 97 of the auxiliary guide device 96 lies at the second guide position F2 substantially parallel to the horizontal plane P, and therefore the guide blocks 89 as guide members are located in the plate discharge passage 39. Meanwhile, when the pivotally moving plate 97 lies at the second guide position F2 and the guide blocks 89 are located in the plate discharge passage 39, the second link member 59 is inclined towards the plate cylinder 4, as represented in solid lines of FIG. 10, and the control pin 48*c* engages with a lower portion of the elongated hole 59*a* so as to prevent the pivotally moving plate 97 from being pivotally moved further in the clockwise direction.

Then, the operator operates a suction switch (not shown) to drive the suction pump of the sucker 50, thereby transmitting a suction force of the suction pump to the respective suction nozzles 52 via the suction pipe 51 so as to suck the rear surface of the printing plate 3, allowing a portion of the printing plate 3 close to the leading edge 20 to be held along the printing plate guide plate 31. In this case, the suction pipe 51 is positioned in the upper regions of the elongated holes 40 and therefore the suction nozzles 52 are also held at the suction position E1 that lies in these upper regions.

Then, the operator operates a plate supply switch (not shown) to stop the leading-edge clamping member 21 at a position at which the leading edge 20 of the printing plate 3 is to be inserted, and subsequently drive the cylinder devices 36 with a periphery of the leading edge 20 of the printing plate 3 held along the printing plate guide plate 31 so that the printing plate guide plate 31, which has been closing the opening 30 until then, is pivotally moved towards the plate cylinder 4 around the support shaft 31*a* (in an anticlockwise direction of FIG. 1) and then shifted to the printing plate supply position C2. By this motion, the leading edge 20 of the printing plate 3 is moved closer to the clamping gripper 15, specifically the leading-edge clamping member 21, of the plate cylinder 4.

On the other hand, along with the pivotal motion of the printing plate guide plate 31 towards the plate cylinder 4, the pivotally moving plate 97 of the auxiliary guide device 96, which has been held at the second guide position F2 until then, is pivotally moved upward at an inclined angle relative to the horizontal plane P as represented in phantom lines into the first guide position F1, and the guide rollers 88 are located in the plate supply passage 38 so as to be closer to the leading edge 20 on the printing plate guide plate 31. That is, along with the pivotal motion of the printing plate guide plate 31 towards the plate cylinder 4, the opening 30 is opened, and this pivotal motion of the printing plate guide plate 31 causes the first link member 58 to be pulled diagonally upward by the pin 48*a* and pivotally moved around the control pin 48*c*. At this moment, along with the movement of the first link member 58, the first elongated hole 58*a* is moved diagonally upward, allowing the control pin 48*c* to be located at a lower end of the first elongated hole 58*a* and held in engagement with the lower circumference of the same. When the first link member 58 is pulled diagonally upward, the pivotally moving plate 97 is pivotally moved around the support shaft 96*a* in an anticlockwise direction of FIG. 10 because of the engagement of the control pin 48*c* with the first elongated hole 58*a*, allowing the pivotally moving plate 97 to be shifted to the first guide position F1, and hence the guide rollers 88 of the aforesaid guide members to be located in the plate supply passage 38. The second link member 59 is engaged with the second elongated hole 59*a* by the movement of the control pin 48*c* along with the motions of the first link member 58 and the pivotally moving plate 97, and hence pivotally moved from the position represented in solid lines of FIG. 10 in the anticlockwise direction to the position represented in phantom lines of FIG. 10.

As described above, the pivotally moving plate 97, which has been held at the second guide position F2, is pivotally moved upward along with the pivotal motion of the printing plate guide plate 31 towards the plate cylinder 4 into the first guide position F1 that is inclined by an angle of θ relative to the second guide position F2. When the pivotally moving plate 97 is moved from the second guide position F2 to the first guide position F1, its leading end is inclined from the second guide position F2 so as to be closer to the leading end of the printing plate guide plate 31 than it is at the second guide position F2. Meanwhile, when the printing plate guide plate 31 is pivotally moved towards the plate cylinder 4, the opening 31 is opened. However, when the printing plate guide plate 31 is pivotally moved towards the plate cylinder 4, the inclined angle of the pivotally moving plate 97 is changed so that the printing plate guide plate 31 and the pivotally moving plate 97 together cover the plate cylinder 4 and the clamping gripper 15 from the front side. Therefore, it is possible to secure a safety working environment for the operator even when the opening 31 is opened by the pivotal motion of the printing plate guide plate 31.

Then, the cylinder device 37 is driven to extend the rod 62, which allows the support block 65 to move towards the stopper 70 along the printing plate guide plate 31 through the body 80 mounted to the rod 62. On the other hand, the protrusion 85, which has been held in engagement with the head 86*b* of the moving member 86 until then, is released from the engagement with the same, and the sucker 50 is moved to the plate supply position E2 at which the suction nozzles 52 are positioned in the lower regions of the elongated holes 40. That is, with the arrangement in which the suction pipe 51 is mounted to the support block 65 via the moving member 86 and the closing member 87, and the suction nozzles 52 are mounted to the suction pipe 51, the suction nozzles 52 move to the leading-edge clamping member 21 of the clamping gripper 15 along the elongated holes 40 while holding the printing plate 3 by the suction force when the support block 65 moves towards the stopper 70 along the printing plate guide plate 31.

When the sucker 50 has moved to the plate supply position E2 with the printing plate 3 positioned correctly relative to the plate cylinder 4 in the width direction B, the cutouts 27, 28 formed in the leading edge 20 of the printing plate 3 are respectively engaged with the protrusions 25, 26 of the leading-edge clamping member 21. Upon the engagement of the cutouts 27, 28 of the leading edge 20 of the printing plate 3 with the protrusions 25, 26 of the leading-edge clamping member 21, the cylinder device 37 stops further extension of the rod 62 by a load resulting from the engaging force, and in this state, the leading-edge clamping member 21 is driven to clamp the leading edge 20 of the printing plate 3.

Thus, with the cutouts 27, 28 of the printing plate 3 held in engagement with the protrusions 25, 26 of the leading-edge clamping member 21, the cylinder device 37 stops before the support block 65 contacts the stopper 70 so that the sucker 50 moves to a given plate supply position E2 and stops its further movement, even if the support block 65 moves towards the stopper 70 along the printing plate guide plate 31. However, in such a case where the operator erroneously operates the suction switch when the printing plate 3 is not inserted in the clearance between the front side of the downstream sided front panel 10 and the receiving frame member 42, the cutouts 27, 28 of the printing plate 3 do not engage with the protrusions 25, 26 of the leading-edge clamping member 21 and therefore the rod 62 keeps its extending motion with no load applied to the cylinder device 37. This extension of the rod 62 of the cylinder device 37 is however stopped by the application of a load to the cylinder device 37, which results from the contact of the support block 65 with the stopper 70.

Now, the description will be made for the case where the printing plate 3 is not correctly positioned relative to the plate cylinder 4 in the width direction B. In this case, the cutouts 27, 28 are out of alignment with the protrusions 25, 26 in the width direction B and therefore they are unlikely to be engaged with each other. In order to address this problem, the block positioning mechanism 72 is provided at each of the opposite ends of the sucker 50. That is, the block positioning mechanism 72 at each end has the elongated hole 41 in the support pieces 81, 82 for allowing the shaft portion 86*a* of the moving member 86 to be inserted thereinto while being movable in the width direction B, and the protrusion 85 is positioned away from the head 86*b* of the moving member 86 so that the moving member 86 is held in such a manner as to be movable along the elongated hole 41 at the plate supply position E2 of the sucker 50.

With the thus arranged positioning mechanism 72 provided at each end of the sucker 50, when the leading edge 20 of the printing plate 3 has been moved towards the leading-edge clamping member 21 at the printing-plate supply position C2 at which the printing plate guide plate 31 has been pivotally moved towards the clamping gripper 15 so as to open the opening 30, the cutouts 27, 28, which happened to be out of alignment with the protrusions 25, 26 in the width direction B, are brought into alignment with the same, as long as a slight engagement or only a kind of hooking engagement (not requiring a full engagement) is present between the outer circumferences 25*a*, 26*a* of the cylindrical protrusions 25, 26 and the lateral side walls 27*a*, 28*a* of the cutouts 27, 28, which engagement causes the protrusions 25, 26 to press the lateral side walls 27*a*, 28*a* of the cutouts 27, 28, thus bringing the cutouts 27, 28 into alignment with the protrusions 25, 26 and hence allowing the printing plate 3 to be mounted at a correct position relative to the plate cylinder 4 in the width direction B.

Then, the suction nozzles 52, which together suck the printing plate 3 and hold the same tightly, allow themselves and the suction pipe 51 to move along with the printing plate 3 towards the leading-edge clamping member 21, while moving in the width direction B, so that the leading edge 20 of the printing plate 3 is clamped by the driving of the leading-edge clamping member 21. Meanwhile, it is assumed that, even if the printing plate 3 is not mounted at a correct position relative to the plate cylinder 4 in the width direction B, the displacement therebetween is generally small. Therefore, even with a slight engagement or only a kind of hooking engagement (not requiring a full engagement) between the cutouts 27, 28 and the protrusions 25, 26, the protrusions 25, 26 can press through their outer circumferences the lateral side walls 27*a*, 28*a* of the cutouts 27, 28 so that the printing plate 3 can be correctly positioned with respect to the width direction B.

The anticlockwise rotation (FIG. 1) of the plate cylinder 4 with the leading-edge clamping member 21 driven and having been clamping the leading edge 20 of the printing plate 3 causes the printing plate 3 to be mounted on the plate cylinder 4. At this moment, the pivotally moving plates 97 are pivotally moved upward by the angle θ relative to the horizontal plane P, and therefore allow the printing plate 3 to be guided along the supply plate guide rollers 88 disposed on the pivotally moving plates 97. The rubber rings 88*b* are mounted on the guide rollers 88, and more specifically, the rubber rings 88*b* are fitted in the grooves 88*a* and each have such a cross sectional diameter as to allow the circumferences of the rubber rings 88*b* to project from the outer circumferences of degree of hardness are themselves necessarily brought into contact with the printing plate 3 when the pivotally moving plate 97 is held at the first guide position F1. In addition, the guide rollers 88 are loosely mounted on the rod member 98 so as to be movable therearound and therefore make it possible to minimize damages to the surface of the printing plate 3. Then, the trailing-edge clamping member 23 of the clamping gripper 15 clamps the trailing edge 22 of the printing plate 3, allowing the printing plate 3 to be tightly mounted on the plate cylinder 4. Thus, the printing section is set in a state for starting a printing operation. On the other hand, once the mounting operation of the printing plate 3 on the plate cylinder 4 has been finished, the cylinder device 37 is again driven to have its rod 62 return towards the cylinder portion 73. Whereby, the sucker 50 entirely moves upward; the suction nozzles 52 return to the suction position E1 at which they suck the printing plate 3 to be subsequently supplied; the protrusion 85 of the block positioning mechanism 72 at each end of the sucker 50 engages with the head 86*b* of the moving member 86; and the sucker 50 is entirely fixed in position in such a manner as to be non-movable relative to the width direction B.

Once the printing plate 3 is mounted on the plate cylinder 4, the cylinder devices 36 is driven to make the rod 62 return towards the cylinder portion 73. Along with this return motion of the printing plate guide plate 31, the first link member 58 is pressed via the pin 48*a* by the printing plate guide plate 31 so that the pivotally moving plate 97 is pivotally moved around the support shaft 96*a* by its own weight in the clockwise direction of FIGS. 9 and 10; the pivotally moving plate 97 is shifted to return to the second guide position F2; the guide blocks 89 of the auxiliary guide device 96 are again located in the plate discharge passage 39. The return motion of the pivotally moving plate 97 (the distance in the clockwise direction) is limited by the engagement of the control pin 48*c* with the lower portion of the second elongated hole 59*a*. Once the printing plate guide plate 31 returns to close the opening 30 upon the driving of the cylinder devices 36, the printing plate guide plate 31 is held at the printing-plate setting position C1. This position also corresponds to the plate discharge position of the printing plate guide plate 31 for discharging the printing plate 3 after the finish of the printing operation. That is, the printing plate guide plate 31 in the plate discharge operation lies at the position at which it closes the opening 30.

For discharging the printing plate 3 upon the finish of the printing, the plate cylinder 4 is rotated so as to move the clamping gripper 15 to a given position, and the trailing edge 22 of the printing plate 3 is released from the clamped engagement with the trailing-edge clamping member 23. Whereby, the trailing edge 22 of the printing plate 3 is removed away from the plate cylinder 4 via the spring force of the printing plate 3 and brought into engagement with the guide blocks 89 located in the plate discharge passage 39. Then, the plate cylinder 4 is rotated in the clockwise direction, thereby moving a portion of the printing plate 3 subsequent to the trailing edge 22 away from the plate cylinder 4 and hence allowing the trailing edge 22 of the printing plate 3 to be drawn into a space between the discharge plate guide plates 91, 92, as the printing plate 3 slides along the guide blocks 89. During this plate discharging operation, ink, solvent or the like used for printing attached to the surface of printing plate during the printing operation is likely to be attached to the guide blocks 89 through the sliding engagement. The printing plate 3 with ink, solvent or the like attached thereto is guided in the plate discharge direction G2 as it slides along the guide blocks 89. The plate cylinder 4 is further rotated in the clockwise direction, thereby allowing the leading-edge clamping member 21 to release the clamping engagement with the trailing edge 22 of the printing plate 3 at a given position. Then, the printing plate 3 clamped from the opposite sides by the clamping rollers 93, 94 is discharged through the upper portion of the downstream sided front panel 10 to the outside of the body cover 2 upon the vertical motions of the clamping rollers 93, 94 effected by the driving of the cylinder device.

As mentioned above, according to the motion of the printing plate 3 at the time of supplying a new printing plate to the plate cylinder 4, there is a possibility that ink or the like is attached to the guide blocks 89 at the time of discharging a used printing plate. It is assumable from this that ink or the like attached on the guide blocks 89 is subsequently attached to a new printing plate to be supplied to the plate cylinder 4. However, with the above described arrangement of this embodiment, in which the pivotally moving plate 97 is held at the first guide position F1 inclined relative to the horizontal plane P in the plate supply operation so that not the guide blocks 89 but the guide rollers 88 are located in the plate supply passage 38, it is possible to prevent ink or the like attached on the guide blocks 89 from being subsequently attached to a new printing plate.

According to the above embodiment of the present invention, the link mechanism 47 as the shifting means, which allows for the pivotal motion of the printing plate guide plate 31 in association with or simultaneously the motion of the pivotally moving plate 97, is disposed so as to operatively connect the printing plate guide plate 31 with the pivotally moving plate 97. With this arrangement, it is not necessary to provide a control device for selection of a member for guiding the printing plate 3 by the contact therewith, an actuator to be driven upon receiving a signal therefrom, and the like. Thus, it is possible to achieve secure and automatic selection on whether the guide rollers 88 or the guide blocks 89 are to be used, by the link mechanism 47 as the shifting means having a simplified structure allowing the pivotal motion of the printing plate guide plate 31 in association with or simultaneously with the motion of the pivotally moving plate 97, so that these guide members can be selectively used in the plate supply and discharge operations, thereby preventing ink or the like from being attached to the printing plate 3 or preventing the printing plate 3 from be scratched or damaged by the contact of an improper guide member.

In a conventional device, a member which directly contacts a plate cylinder is provided, while a guide member which rotates by an amount corresponding to the rotational distance of the directly contact member is provided. In this arrangement a possible deterioration in reliability due to slippage between the plate cylinder and the guide member or any other factors must be taken into account. However, according to the above embodiment of the present invention, the selection on whether the guide rollers 88 or the guide blocks 89 are to be used are achieved by making the pivotally moving plate 97 move in association with or simultaneously with the motion of the printing plate guide plate 31 irrespective of the rotation of the plate cylinder 4. This achieves the printing press that is capable of maintaining a high reliability over a long time. As an additional advantage, during the opening 31 is held open by pivotally moving the printing plate guide plate 31 towards the plate cylinder 4, the inclined angle of the pivotally moving plate 97 is changed so as to cover the plate cylinder 4 and the clamping gripper 15 from the front side. This secures a safety working environment for the operator.

In the above embodiment, as the guide, the combination of the guide rollers 88 and the guide blocks 89 is used, while the present invention is not necessarily limited to this. In the above embodiment, the essential feature lies in that the upper portion 89*a* of the leading end of each guide block 89 is formed with a curved surface and the guide blocks 89 protrude to have the upper portions 89*a* located above the outer circumferences of the guide rollers 88. This may be achieved by employing rollers in place of the guide blocks 89. These rollers are also brought out of contact with the printing plate 3 when the pivotally moving plate 97 is held at the first guide position F1, and into contact with the printing plate 3 when the pivotally moving plate 97 is held at the second guide position F2. For this, the rollers may be mounted on the rod member 98 eccentrically relative to the guide rollers 88 in a non-rotatable manner relative to the rod member 98. It is not necessarily limit the number of guide rollers 88, the guide blocks 89 or the like, the dimension or size thereof. The width of the guide rollers 88, the guide blocks 89 or the like may be varied, as long as the printing plate 3 can be supplied and discharged as smooth as possible.

This specification is by no means intended to restrict the present invention to the preferred embodiments set forth therein. Various modifications to the printing press, as described herein, may be made by those skilled in the art without departing from the spirit and scope of the present invention as defined in the appended claims.

What is claimed is:

1. A printing press comprising:

a plate cylinder for mounting a printing plate thereon;

a clamping gripper disposed on said plate cylinder for gripping the printing plate;

a printing plate guide plate for supplying the printing plate to the plate cylinder in a plate supply operation so as to have a leading edge of the printing plate clamped by the clamping gripper, and discharging the printing plate from the plate cylinder in a plate discharge operation, said printing plate guide plate being shiftable between a plate supply position enabling supply of the printing plate to the clamping gripper and a plate discharge position enabling discharge of the printing plate in a plate discharge direction;

a guide for guiding the printing plate when the printing plate with the leading edge clamped by the clamping gripper is mounted on the plate cylinder in the plate supply operation, and guiding the printing plate in the plate discharge direction in the plate discharge operation;

said guide having a leading end provided with a guide portion;

said guide being shiftable between a first guide position at which the guide has the guide portion located in a plate supply passage between the printing plate guide plate and the clamping gripper and is held at a first inclined angle relative to a reference plane allowing the guide portion to contact the printing plate in the plate supply passage, and a second guide position at which the guide has the guide portion located in a plate discharge passage formed radially outward of the plate cylinder relative to the clamping gripper and is held at a second inclined angle different from the first inclined angle relative to the reference plane allowing the guide portion to contact the printing plate in the plate discharge passage; and a shifting means through which the printing plate guide plate is linked with the guide so that the guide is shifted to the first guide position simultaneously when the printing plate guide plate is shifted to the plate supply position and the guide is shifted to the second guide position simultaneously when the printing plate guide plate is shifted to the plate discharge position.

2. The printing press according to claim 1, wherein said guide portion comprises at least one first guide member that is capable of contacting the printing plate only when the guide is held at the first guide position, and at least one second guide member that is capable of contacting the printing plate only when the guide is held at the second guide position.

3. The printing press according to claim 1, further comprising a body cover having an opening for insertion of the printing plate, wherein said printing plate guide plate is pivotally movably mounted to said body cover via a support shaft, so that when the printing plate guide plate is held at the plate supply position at which the printing plate guide plate is inclined towards the plate cylinder so as to open the opening of the body cover, the guide is shifted to the first guide position at which the guide is held at an angle inclined towards a space between the opening of the body cover and the plate cylinder so as to cover the plate cylinder from the outside of the body cover.

* * * * *